US007146971B2

(12) United States Patent
Mokry

(10) Patent No.: US 7,146,971 B2
(45) Date of Patent: Dec. 12, 2006

(54) IMPELLER AND A SUPERCHARGER FOR AN INTERNAL COMBUSTION ENGINE

(76) Inventor: Peter G. Mokry, 169 Jane Street, Toronto (CA) M6S 3Y8

( * ) Notice: Subject to any disclaimer, the term of this patent is extended or adjusted under 35 U.S.C. 154(b) by 13 days.

(21) Appl. No.: 10/871,217

(22) Filed: Jun. 18, 2004

(65) Prior Publication Data

US 2004/0255917 A1 Dec. 23, 2004

(30) Foreign Application Priority Data

Jun. 20, 2003 (CA) ..... 2432831

(51) Int. Cl.

| | |
|---|---|
| ***F02B 33/00*** | (2006.01) |
| ***F02B 39/00*** | (2006.01) |
| ***B63H 1/00*** | (2006.01) |
| ***B63H 1/16*** | (2006.01) |
| ***B63H 1/26*** | (2006.01) |
| *B22C 7/02* | (2006.01) |
| *B22C 9/04* | (2006.01) |
| *B22C 9/22* | (2006.01) |

(52) U.S. Cl. ..... 123/559.1; 416/198 A; 416/186 R; 416/228 X; 416/206

(58) Field of Classification Search ..... 123/559.1; 416/198 A, 186 R, 228 X, 175, 203, 188; 415/206

See application file for complete search history.

(56) References Cited

U.S. PATENT DOCUMENTS

| | | | | |
|---|---|---|---|---|
| 2,482,462 | A | 9/1949 | Browne | |
| 2,859,933 | A | 11/1958 | Whitaker | |
| 2,941,780 | A | 6/1960 | von der Nuell et al. | |
| 3,065,954 | A | 11/1962 | Witaker | |
| 3,285,187 | A | 11/1966 | Anderson, Jr. | |
| 3,754,834 | A | 8/1973 | Wolters | |
| 3,893,817 | A | 7/1975 | Hackbarth et al. | |
| 3,958,905 | A | 5/1976 | Wood | |
| 4,204,807 | A * | 5/1980 | Takizawa et al. | 416/188 |
| 4,502,837 | A | 3/1985 | Blair et al. | |
| 5,593,085 | A | 1/1997 | Tohill et al. | |
| 5,961,281 | A | 10/1999 | Ojima et al. | |
| 6,033,183 | A * | 3/2000 | Genster | 416/186 R |
| 6,102,661 | A * | 8/2000 | Robson et al. | 416/228 |
| 6,338,610 | B1 * | 1/2002 | Harada et al. | 416/186 R |
| 6,390,942 | B1 * | 5/2002 | Wheeler et al. | 123/559.1 |
| 6,413,039 | B1 | 7/2002 | Morris et al. | |
| 6,449,950 | B1 | 9/2002 | Allen et al. | |
| 6,468,038 | B1 | 10/2002 | Kikuchi et al. | |

(Continued)

FOREIGN PATENT DOCUMENTS

DE 4030817 A1 * 4/1992

(Continued)

*Primary Examiner*—Thai-Ba Trieu

(57) ABSTRACT

An impeller for a supercharger for an internal combustion engine and a supercharger incorporating such an impeller is disclosed. The impeller includes a molded upper part having a top wall defining a top opening. The top wall extends outwardly to a lateral edge and the top wall includes a plurality of vanes extending therefrom. The upper part is shaped to permit said upper part to be formed in a parting mold. A molded lower part is also provided which includes a bottom wall extending outwardly to a lateral side edge. The lower part has a plurality of radially extending vanes, and the lower part is shaped to permit said lower part to be formed in a parting mold. The upper and lower parts may be attached together to form a high speed molded impeller, which in turn is incorporated into a supercharger for an internal combustion engine.

1 Claim, 1 Drawing Sheet

U.S. PATENT DOCUMENTS

| | | | | |
|---|---|---|---|---|
| 6,592,329 | B1 * | 7/2003 | Hirose et al. | 416/203 |
| 2001/0055539 | A1 | 12/2001 | Nakamura et al. | |
| 2005/0163614 | A1 * | 7/2005 | Chapman | 415/206 |
| 2005/0196272 | A1 * | 9/2005 | Nikapour | 415/206 |

FOREIGN PATENT DOCUMENTS

| | | | |
|---|---|---|---|
| GB | 761937 | * | 11/1956 |
| RU | 2183772 C2 | * | 6/2002 |

* cited by examiner

IMPELLER AND A SUPERCHARGER FOR AN INTERNAL COMBUSTION ENGINE

FIELD OF THE INVENTION

This invention relates generally to the field of internal combustion engines and more particularly to the field of automotive engines. Most particularly this invention relates to superchargers that are used to increase the performance of such engines.

BACKGROUND OF THE INVENTION

Superchargers and turbochargers are well known devices for increasing the performance of internal combustion engines. These devices include an impeller to drive more air (and thus oxygen) into the combustion chamber to "boost" performance. The impeller is typically housed in a volute chamber which directs the air flow into the combustion engine.

The ever increasing demands from the motor-sport consumer require higher boost pressures and flow rates from highly efficient superchargers. This level of performance is achieved by very high rotational speeds, some in excess of 60,000 RPM. To get the desired performance from a supercharger, the impeller is subjected to extreme stresses as set out in more detail below.

Those whom are expert in the field will recognize that the centrifugal forces exerted on the impeller are more extreme as rotational speeds increase. Those whom are expert in the field will also recognize that tangential stress, otherwise known as 'hoop stress', experienced by the outer portions of the hub and shroud, far exceeds the radial stress that is experienced by the vanes. It is for this reason, in addition to preferable pressure/flow characteristics, that impellors designed for high speed rotational operation must have vanes that are perpendicular to the rotational axis, as they are critical in reinforcing the impeller, and thus having a rake angle that is greater or less than zero degrees will diminish the strength of the vane on the impeller. What is desired is an impeller design which can perform efficiently while withstanding the high stresses due to the high rotational speeds required for its intended use.

Previous art (Genster, Albert—U.S. Pat. No. 6,033,183) (Hirose et al—U.S. Pat. No. 6,592,329 B1) (Chapman, Albert—US-2005/0163614 A1) claims vanes that are reinforced by the hub and shroud, thus contradicting the tangential/radial stress relation mentioned above. This makes them unstable and thus unsuitable for high speed operation as would be required for applications such as a supercharger or a high pressure blower. Previous art (Harada et al.—U.S. Pat. No. 6,338,610 B1)(Nikpour, Bahram—US—2005/0196272 A1) (Chapman, Thomas R.—US-2005/0163614 A1), (The Garrett Corp.—GB-761937), (W U, Chiang-Fu—DE4030817 A1), (Nikolaev Yu et al.—RU-2183772) show vanes that have a zero rake angle at the central portion of the impeller which then proceeds to a negative rake angle at the outer periphery, or have a negative rake angle the whole length of the vane. These designs are also likely to fail when applied to superchargers for the reasons mentioned above as the vane rake angle at their periphery is greater/less than zero and thus weakened. In addition, as is commonly known by those who are expert in the field, an impeller with vanes that are negatively raked will exhibit pressure/flow characteristics in which pressure drops as flow increases, and for this reason they are unsuitable for use in a supercharger as many of them claim. This is because the moment the throttle is opened and the air flow increases, the boost pressure will drop. The negatively sloping curve on the pressure/flow charts in previous art (Harada at al.—U.S. Pat. No. 6,338,610 B1 FIG. 8) shows this. In a supercharger application it is preferable that the level of boost increases as flow increases, or at the very least remain the same.

SUMMARY OF THE INVENTION

The present invention is directed to the design of a high speed impeller for a supercharger which has features to provide higher efficiencies while providing structural stability at higher rotational speeds than in prior art.

This invention features a vane profile that is inverse to the profile shown in the previous art in that there is a zero rake angle at the outer periphery which continues to the mid section at which point the vane curves between 5 to 10 degrees from the central axis, and then proceeds offset from the central axis toward the central portion of the hub. The curvature of 5 to 10 degrees results in a weakening of the vane by 8 to 17%, this however can be reinforced as it is in the portion of the impeller with the rising hub. This design is contrary to other claims which fail to realize the extreme stresses involved on account of the high rotational speeds required for superchargers, thus making them unstable for high speed operation. By having a vane with an inverse profile, a pressure/flow characteristic suitable for a supercharger is experienced, as with an impeller with vanes that have a zero rake angle throughout, but with the higher efficiencies of an impeller with a negative rake angle, and the stability required for high speed operation. CFD (Calculated Flow Dynamics) tests have confirmed that the pressure increases along with an increasing flow rate. Increasing the flow from 400 CFM (atmospheric pressure) to 800 CFM (atmospheric pressure) results in an increase of pressure by ½ PSI, which is perfectly acceptable in a supercharger application. Also an FEA (Finite Element Analysis) of the present design has shown that an impeller with a 15.5 cm (6.1 in) diameter can easily tolerate rotational velocities up to 60,000 RPM, thus having stresses well within the yield of various aluminum alloys.

Although the centrifugal forces are much lower at the inlet portion of the impeller, they exist none the less, thus creating a moment at the base of the vane at the portion where there is a negative rake angle. This moment, which is continuously varying as does the impellers rotational velocity, in addition to the high centrifugal force, will ultimately cause the tips of the vanes at the impeller inlet to break off. For this reason it is essential for the design of the impeller to have an outer wall or shroud.

The purpose of the shroud, in addition to improving the fluid mechanical properties as discussed in more detail bellow, is to add torsional rigidity to the tips of the blades at the inlet thus canceling out the moment and its negative effects. The shroud also provides a relatively flat surface, located on a plane generally perpendicular to the axis of rotation of the impeller onto which a seal can be formed. In this way the present invention prevents recirculating of the air thereby increasing the overall efficiency. In addition because the present invention comprehends a top wall, a bottom wall, and at least some vanes which extend fully therebetween, air which might otherwise pass over the vanes cannot do so. Both of these aspects improve the efficiency of the present impeller design over the prior art designs.

BRIEF DESCRIPTION OF THE DRAWINGS

Reference will now be made, by way of example only, to preferred embodiments of the present invention with reference to the attached figures in which.

DETAILED DESCRIPTION OF THE PREFERRED EMBODIMENTS

Figure 1:
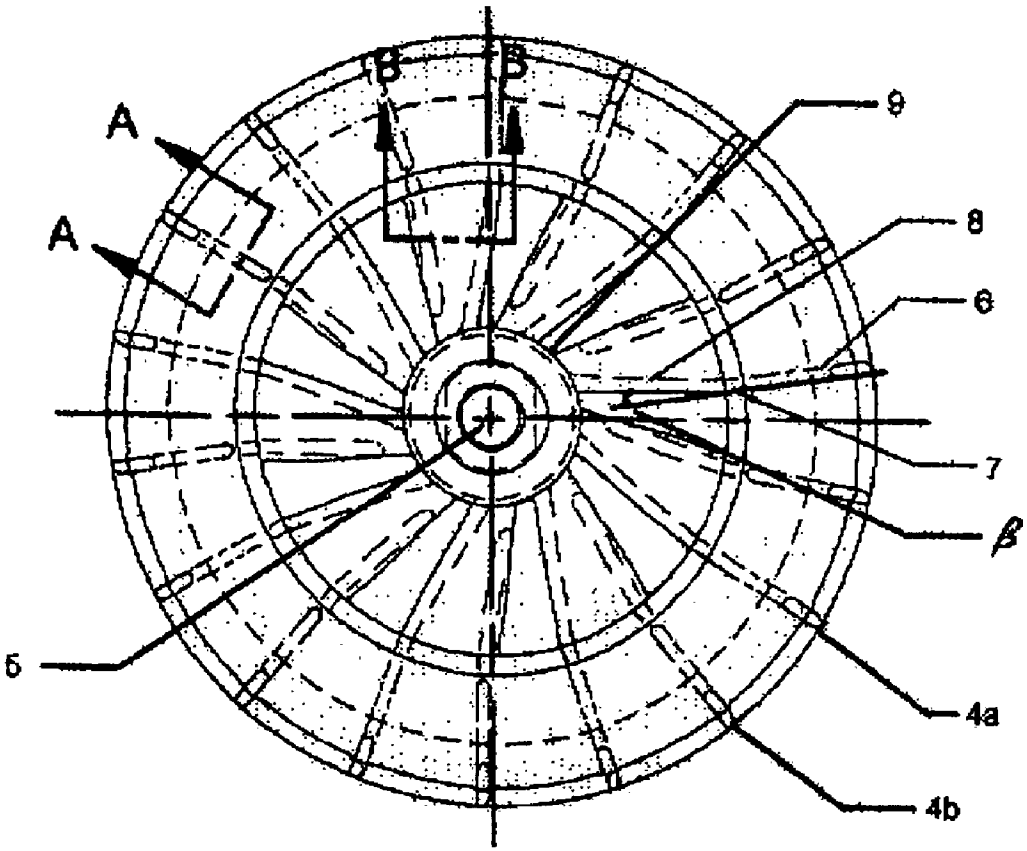
FIG. 1 is a top view of the impeller showing the location of the vanes with hidden lines.

FIG. 1 shows an impeller from the top view. The primary vanes (4*a*) and secondary vanes (4*b*) feature an inverse profile such that they start perpendicular to the rotational axis (5) from the outer periphery (6), and continue to the mid section (7) upon which they are offset 5 to 10 degrees (angle β) away form the central axis (5) of the impeller, and then proceed to meet with the central portion of the hub (9).

Figure 2:
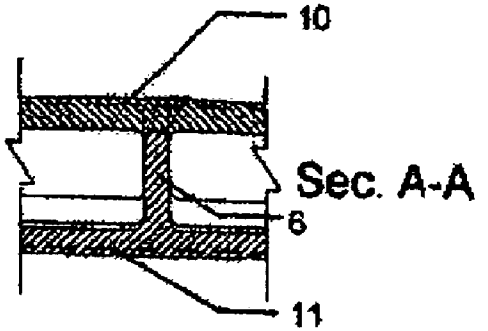
FIG. 2 is a cross-sectional view along lines A—A of FIG. 1.

FIG. 2 shows the x-sectional view of section A—A which displays the outer shroud (10), the section of vane perpendicular to the central axis (6), and the base of the hub (11).

Figure 3:
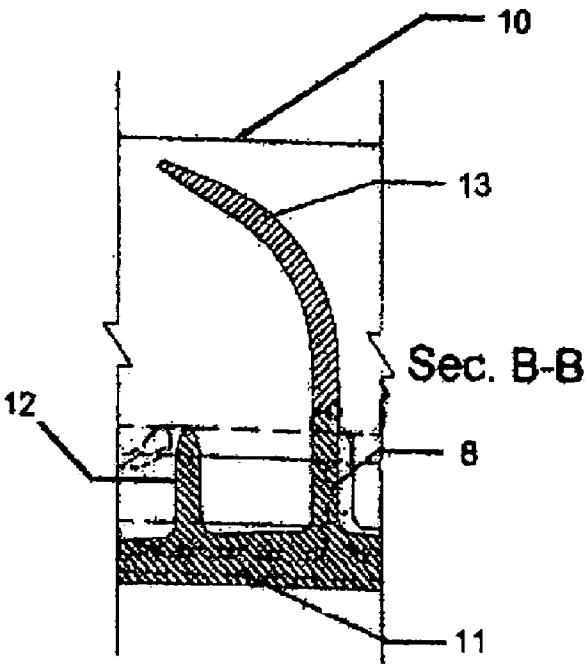
FIG. 3 is a cross-sectional view along lines B—B of FIG. 1.

FIG. 3 shows the x-sectional view of section B—B which displays the outer shroud (10), the base of the hub (11), and the section of vane angled 5 to 10 degrees (8) away from the central axis. It also shows a smaller secondary vane (12) which is positioned in between the primary vanes, and the curve of the inlet blades (13).

It can now be understood that when the impeller is rotating the air is drawn into the open top and forced by the rotation of the vanes of the impeller between the top and bottom walls and then out the lateral side edges. The present impeller design therefore provides both a top wall or shroud (10) consisting of a vertical wall and the planar portion, and a bottom wall or hub (11), to prevent air from recirculating or passing across the tops of the vanes as the vanes are rotating at speed. The use of both the top and bottom walls increase the mechanical and the isentropic efficiency of the present invention over the open faced impellers of the prior art. With a higher efficiency impeller the exit air temperature is lower which is beneficial for a combustion engine.

Another feature of the present invention is that the vanes, at the inlet end (B), have a negative rake angle (β) as a result of the inverse vane profile which can be seen in FIG. 1. In this way the acceleration profile of the air past the vanes is somewhat more aerodynamically efficient, thereby improving the efficiency of the impeller design, when operating at high speeds. The improved design essentially reduces the shock to the incoming air as it is accelerated outward. The inverse vane profile also provides pressure/flow performance characteristics as does an impeller with a zero rake angle throughout, and as a result is suitable for automotive applications. The rake angle of the vanes requires additional strength however, as explained in more detail below.

As mentioned earlier, the shroud or outer wall (10) provides torsional rigidity and resists the moment generated at high rotational speeds by the negatively raked vane portions (8). This outer wall is essential to the design of the impeller, as the tips of the vanes will likely break off (a problem for high speed impellers) from continuously varying moment placed upon them and the eventual work hardening of the material as a result.

Due to the tangential/radial stress relation mentioned earlier, the shroud (10) is dependant on the vanes for reinforcement, and so adds an additional load onto the vanes (4*a* and 4*b*) as a result of the centrifugal forces. On account of this, the strength can be improved by increasing the number of primary vanes (4*a*) or secondary vanes (4*b*). Increasing the number of vanes is also an effective way to increase the impeller efficiency, since a theoretically perfect impeller would have an infinite number of vanes that are infinitesimally thin, as is described by many fluid mechanics text books. The vanes can be reinforced by adding a slight taper.

The impeller is to be precision/investment cast using aluminum alloys 354T6, 201T7, and A/B206, or any other precision casting materials exhibiting very high strength to weight ratios.

The embodiments of the invention in which an exclusive property or privilege is claimed are defined as follows:

1. A supercharger impeller comprising;

a central hub;

an outer shroud;

an inlet at a center of said central hub;

an exit at a peripheral portion of said hub;

a plurality of primary and secondary vanes being between said central hub and said outer shroud including a plurality of passages for fluid accelerating from said inlet at the center of said central hub to said exit at the peripheral portion of said hub to rotate said plurality of vanes about a central axis of the supercharger impeller;

each of said plurality of primary and secondary vanes further characterizing:

an inverted profile starting with a zero rake angle at the outer periphery and continuing to a middle section of said supercharger impeller; and at a point of the middle section of said supercharger impeller; and at a point of a middle section each of said plurality of vanes curving five to ten degrees to a negative rake angle that proceeds the central axis of said supercharger impeller; and said supercharger impeller being casting aluminum alloy of 354T6, 201T7, and A/B206.

* * * * *